US007040118B2

(12) United States Patent
Jung

(10) Patent No.: US 7,040,118 B2
(45) Date of Patent: May 9, 2006

(54) INTEGRATED-TYPE SUCTION PIPE MODULE AND REFRIGERATOR HAVING THE SAME

(75) Inventor: Sang Gyu Jung, Kwangiu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 23 days.

(21) Appl. No.: 10/728,891

(22) Filed: Dec. 8, 2003

(65) Prior Publication Data

US 2004/0144130 A1 Jul. 29, 2004

(30) Foreign Application Priority Data

Jan. 24, 2003 (KR) ..... 10-2003-0004865

(51) Int. Cl.
*F25D 19/00* (2006.01)
*F25B 41/00* (2006.01)

(52) U.S. Cl. ..... 62/513; 62/298

(58) Field of Classification Search ..... 62/513, 62/298, 441
See application file for complete search history.

(56) References Cited

U.S. PATENT DOCUMENTS 1,800,255 A * 4/1931 Hull ..... 62/288
4,294,081 A 10/1981 Mitiani et al.

FOREIGN PATENT DOCUMENTS

JP 10160324 A * 6/1998
JP 11304338 A * 11/1999

* cited by examiner

*Primary Examiner*—Chen Wen Jiang
(74) *Attorney, Agent, or Firm*—Staas & Halsey LLP

(57) ABSTRACT

An integrated-type suction pipe module for refrigerators, and a refrigerator having the integrated-type suction pipe module allow a suction pipe to be completely isolated from an interior of the refrigerator and an atmosphere. The integrated-type suction pipe module includes a suction pipe, and a foam body. The suction pipe defines a refrigerant path between an evaporator and a compressor. The suction pipe has an exposed part placed in a machine room which is exposed to an atmosphere, and an embedded part which is placed to be isolated from the atmosphere. The embedded part is disposed in the foam body. The construction enhances work efficiency while producing a refrigerator, and simplifies a design of a machine room to provide a better appearance. Further, the suction pipe is completely isolated from the atmosphere, thus preventing dew from being formed on the suction pipe. A heat exchanging effect between a capillary tube and the suction pipe is maximized.

24 Claims, 2 Drawing Sheets

INTEGRATED-TYPE SUCTION PIPE MODULE AND REFRIGERATOR HAVING THE SAME

CROSS-REFERENCE TO RELATED APPLICATIONS

This application claims the benefit of Korean Patent Application No. 2003–4865, filed Jan. 24, 2003 in the Korean Intellectual Property Office, the disclosures of which are incorporated herein by reference.

BACKGROUND OF THE INVENTION

1. Field of the Invention

The present invention relates, in general, to an integrated-type suction pipe module and a refrigerator having the integrated-type suction pipe module and, more particularly, to a refrigerator having an integrated-type suction pipe module which is constructed such that a suction pipe is embedded in a foam body.

2. Description of the Related Art

Generally, a refrigerator is provided with a refrigerant circuit. The refrigerant circuit includes a compressor, a condenser, a pressure reducing unit, an evaporator, and refrigerant pipes. The compressor compresses a refrigerant. The condenser condenses the refrigerant fed from the compressor. The pressure reducing unit comprises a capillary tube or an expansion valve, and reduces a pressure of the refrigerant fed from the condenser. The evaporator evaporates the refrigerant fed from the pressure reducing unit, and absorbs heat from air which circulates in a cooling compartment of the refrigerator, thus cooling the cooling compartment. The refrigerant pipes connect the compressor, the condenser, the pressure-reducing unit, and the evaporator to each other, to provide a path where the refrigerant flows.

The evaporator is installed in the cooling compartment of the refrigerator, while the compressor, the condenser, and the pressure-reducing unit are placed in a machine room defined in a cabinet of the refrigerator at an outside of the cooling compartment.

Of the refrigerant pipes, a refrigerant pipe to define a path where the refrigerant flows from the evaporator into the compressor is designated as a suction pipe. The conventional suction pipe is designed such that a part of the suction is arranged between an outer casing of the cabinet to form an outer surface of the refrigerator and an inner casing of the cabinet to form an inner surface of the refrigerator, while being embedded in a urethane foam body to be isolated from an interior of the cooling compartment and the atmosphere. Further, another part of the suction pipe which is exposed to the machine room, is covered with a tube to be isolated from the atmosphere.

However, the conventional refrigerator having such a suction pipe has a problem in that it is difficult to appropriately arrange the suction pipe between the outer casing and the inner casing of the cabinet so that the suction pipe is completely isolated from a surface of the inner casing, thus a heat exchange process may occur between the interior of the cooling compartment and the suction pipe. The refrigerator has another problem in that the part of the suction pipe which is placed in the machine room and is covered with the tube, may not be completely covered with the tube at both ends of the tube, thus dew may be formed on the exposed parts of the suction pipe. The refrigerator has a further problem in that the part of the suction pipe which is covered with the tube is exposed to the machine room, thus degrading the appearance of the machine room.

SUMMARY OF THE INVENTION

Accordingly, it is an aspect of the present invention to provide an integrated-type suction pipe module for refrigerators, which allows a suction pipe to be completely isolated from an interior of the refrigerator and an atmosphere.

It is another aspect of the present invention to provide a refrigerator having the integrated-type suction pipe module.

Additional aspects and/or advantages of the invention will be set forth in part in the description which follows and, in part, will be obvious from the description, or may be learned by practice of the invention.

The above and/or other aspects are achieved by an integrated-type suction pipe module for refrigerators, including a suction pipe and a foam body. The suction pipe defines a refrigerant path between an evaporator and a compressor, and has an exposed part placed in a machine room which is exposed to an atmosphere, and an embedded part which is placed to be isolated from the atmosphere. The embedded part is disposed in the foam body.

The integrated-type suction pipe module may further include a tube to cover a part of the exposed part of the suction pipe, which is connected to the evaporator. In this case, the tube is disposed, at an end thereof, in the foam body.

The integrated-type suction pipe module may further include a capillary tube arranged in parallel to the suction pipe.

The integrated-type suction pipe module may further include a cover to cover the foam body in which the embedded part is disposed. A locking part may be provided at a predetermined portion of the cover to mount the cover to a cabinet of a refrigerator. Further, the integrated-type suction pipe module may include a tube to cover a part of the exposed part of the suction pipe, which is connected to the evaporator. In this case, the tube is disposed, at an end thereof, in the foam body. The integrated-type suction pipe module may further include a capillary tube arranged in parallel to the suction pipe.

The above and/or other aspects are achieved by a refrigerator, including a cooling compartment, a machine room thermally insulated from the cooling compartment and opened to an atmosphere, an evaporator installed at a predetermined position in the cooling compartment, a compressor installed at a predetermined position in the machine room, and an integrated-type suction pipe module mounted to a predetermined portion of the machine room. The integrated-type suction pipe module includes a suction pipe, and a foam body. The suction pipe has an exposed part placed in the machine room, and a embedded part which is placed to be isolated from the atmosphere. The embedded part is disposed in the foam body.

The integrated-type suction pipe module may further include a tube to cover a part of the exposed part of the suction pipe, which is connected to the evaporator. In this case, the tube is disposed, at an end thereof, in the foam body.

The integrated-type suction pipe module may further include a capillary tube arranged in parallel to the suction pipe.

The integrated-type suction pipe module may further include a cover to cover the foam body in which the embedded part is disposed. A locking part may be provided at a predetermined portion of the cover to mount the cover to a predetermined portion of the machine room. The integrated-type suction pipe module of the refrigerator may further include a tube to cover a part of the exposed part of the suction pipe, which is connected to the evaporator. In this case, the tube is disposed, at an end thereof, in the foam body. The integrated-type suction pipe module of the refrigerator may further include a capillary tube arranged in parallel to the suction pipe.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
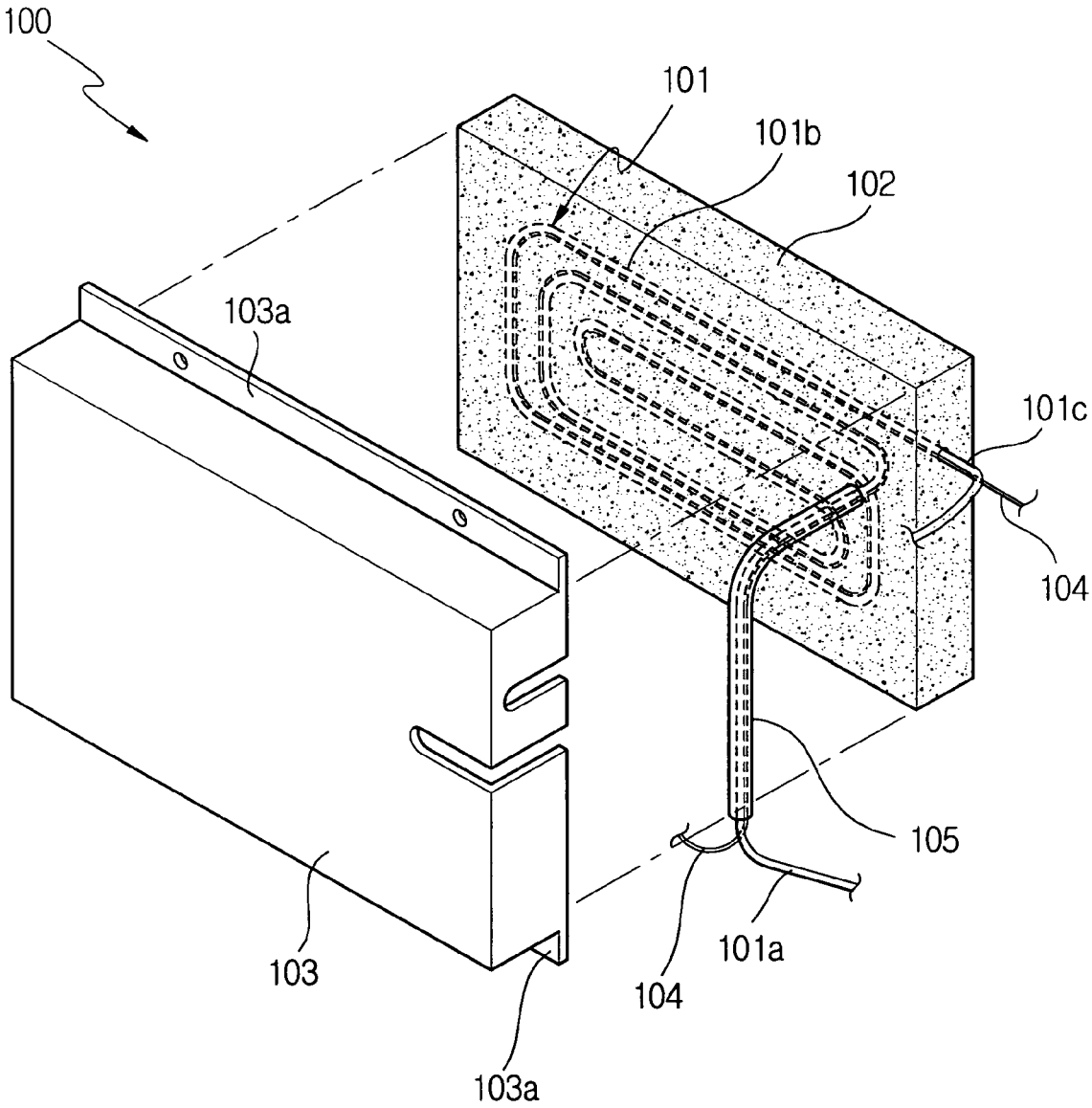
FIG. 1 is an exploded perspective view of an integrated-type suction pipe module for refrigerators, according to an embodiment of the present invention.

Reference will now be made in detail to the present preferred embodiments of the present invention, examples of which are illustrated in the accompanying drawings, wherein like reference numerals refer to like elements throughout.

FIG. 1 is an exploded perspective view of an integrated-type suction pipe module 100 for refrigerators, according to an embodiment of the present invention.

Figure 2:
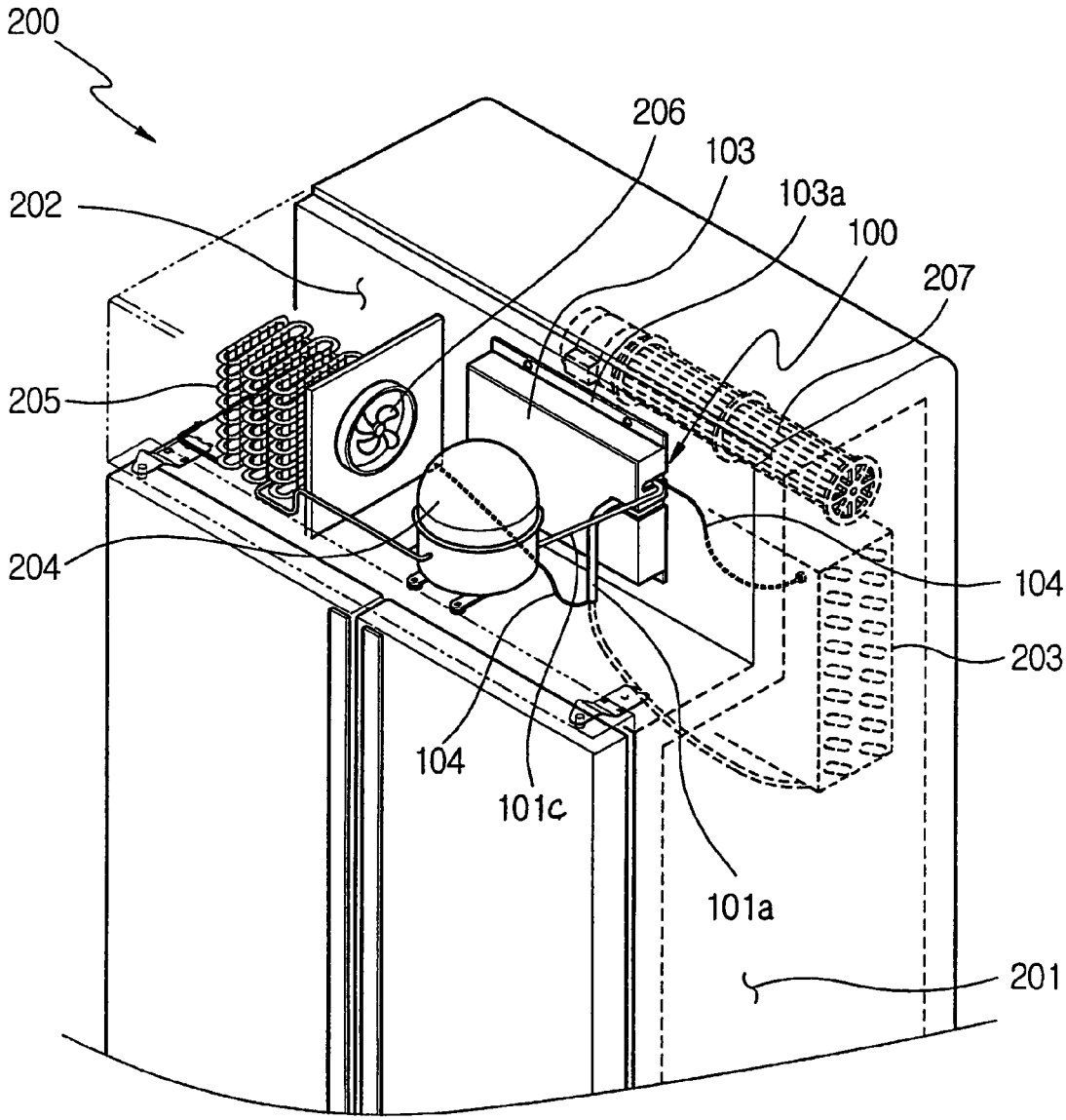
FIG. 2 is a perspective view showing an upper portion of a refrigerator to which the integrated-type suction pipe module of FIG. 1 is applied.

As shown in FIG. 1, the integrated-type suction pipe module 100 includes a suction pipe 101 which defines a refrigerant path between an evaporator 203 and a compressor 204 (FIG. 2). The suction pipe 101 includes first and second exposed parts 101*a* and 101*c*, and an embedded part 101*b*. The first and second exposed parts 101*a* and 101*c* are placed in a machine room 202 which is exposed to an atmosphere. The embedded part 101*b* is disposed in a foam body 102 to be isolated from the atmosphere. A box-shaped cover 103 covers the foam body 102 in which the embedded part 101*b* is disposed. A capillary tube 104 is arranged parallel to the suction pipe 101. The integrated-type suction pipe module 100 also includes a tube 105 to cover the first exposed part 101*a* of the suction pipe 101, which is connected to the evaporator 203.

The capillary tube 104 has a considerably small diameter, in comparison with refrigerant pipes including the suction pipe 101. Thus, when a refrigerant fed from a condenser 205 passes through the capillary tube 104 having the small diameter, a pressure and a temperature of the refrigerant are reduced while some of the refrigerant may evaporate in the capillary tube 104 before the refrigerant is fed to the evaporator 203. Therefore, performance of the evaporator 203 may be deteriorated, resulting in a reduction in an operational efficiency of a refrigerator 200. However, the integrated-type suction pipe module 100 of the present invention overcomes the above-mentioned problems, as follows. Generally, the refrigerant flowing through the capillary tube 104 has a higher temperature than the refrigerant flowing through the suction pipe 101. Thus, a heat exchange process is carried out between the suction pipe 101 and the capillary tube 104 of the present invention, thus lowering a temperature of the refrigerant which flows through the capillary tube 104, therefore reducing the amount of the refrigerant evaporating in the capillary tube 104. Further, as described above, the capillary tube 104 is arranged parallel to the suction pipe 101, so that a temperature of the suction pipe 101 increases, thus preventing dew from being formed on the suction pipe 101.

Of the first and second exposed parts 101*a* and 101*c* of the suction pipe 101, the first exposed part 101*a* is connected to the evaporator 203 which is installed in a cooling compartment 201 of the refrigerator 200. The second exposed part 101*c* is connected to the compressor 204 which is placed in the machine room 202. Further, locking flanges 103*a* extend along upper and lower edges of the cover 103. The cover 103 is mounted to a cabinet of the refrigerator 200 using the locking flanges 103. The locking flanges 103 may be mounted to the cabinet in a screw-type fastening method. Further, an end of the tube 105 is disposed in the foam body 102 to completely isolate the suction pipe 101 from the atmosphere.

The integrated-type suction pipe module 100 constructed as described above allows the suction pipe 101 to be completely isolated from both the cooling compartment 201 and the atmosphere. Thus, during an operation of a refrigerant circuit, any heat exchange process does not occur between the suction pipe 101 and the cooling compartment 201 or the atmosphere, but heat is transferred between the suction pipe 101 and the capillary tube 104.

FIG. 2 is a perspective view showing an upper portion of the refrigerator 200 to which the integrated-type suction pipe module of FIG. 1 is applied.

As shown in FIG. 2, the cooling compartment 201 is defined in the refrigerator 200. The machine room 202 is defined at a front of the upper portion of the refrigerator 200 to be opened to the atmosphere. The evaporator 203 is installed at a rear portion of an upper portion of the cooling compartment 201. The compressor 203 is installed at a predetermined position of the machine room 202. The integrated-type suction pipe module 100 of FIG. 1 is mounted to a rear surface of the machine room 202, which is in back of the compressor 204. Further, the condenser 205 is installed at a left side of the machine room 202. A fan 206 is provided between the condenser 205 and the compressor 204 to blow external air to the condenser 205 and the compressor 204. The capillary tube 104 connects the condenser 205 to the evaporator 203. A part of the capillary tube 104 extending from the condenser 205 meets the first exposed part 101*a* of the suction pipe 101 which extends from the evaporator 203. Thereafter, the capillary tube 104 extends in parallel to the suction pipe 101 in the foam body 102. Further, a part of the capillary tube 104 which is connected to the evaporator 203, comes out of the foam body 102 together with the second exposed part 101*c* of the suction pipe 101 which is connected to the compressor 204.

Thus, the refrigerant which flows from the condenser 205 through the capillary tube 104 to the evaporator 203, dissipates heat to the suction pipe 101 while flowing through the part of the capillary tube 104 which extends in the foam body 102 together with the embedded part 101*b* of the suction pipe 101. Therefore, the temperature of the refrigerant flowing in the capillary tube 104 is reduced. Meanwhile, the refrigerant flowing through the suction pipe 101 absorbs heat from the capillary tube 104 while flowing from the first exposed part 101*a* of the suction pipe 101 extending from the evaporator 203 to the second exposed part 101*c* extending to the compressor 204. Thus, when the refrigerant flowing through the suction pipe 101 reaches the second exposed part 101*c* extending to the compressor 204, the temperature of the refrigerant is increased close to a normal temperature. Thus, it is unnecessary to cover the second exposed part 101*c* which is connected to the compressor 204, with a tube. Of course, the second exposed part 101*c* may be covered with a tube to prevent atmospheric air from contacting the second exposed part 101*c*, if necessary. The reference numeral 207 of FIG. 2 denotes an evaporator fan which functions to circulate the air of the cooling compartment 201 through the evaporator 203.

In FIG. 2, the machine room 202 is defined in the upper portion of the refrigerator. However, the machine room may be defined in a lower portion of the refrigerator without being limited to the embodiment of FIG. 2.

As apparent from the above description, the present invention provides an integrated-type suction pipe module for refrigerators, which enhances work efficiency while producing a refrigerator and simplifies a structure of a machine room to provide a good appearance. Further, a suction pipe is completely isolated from the atmosphere, thus preventing dew from being formed on the suction pipe. The integrated-type suction pipe module of the present invention prevents heat from being transferred between the suction pipe and an interior of a refrigerator, or between the suction pipe and the atmosphere, thus maximizing a heat exchanging effect between a capillary tube and the suction pipe, therefore increasing an operational efficiency of the refrigerator.

Although an embodiment of the present invention has been shown and described, it would be appreciated by those skilled in the art that changes may be made in these embodiments without departing from the principles and spirit of the invention, the scope of which is defined in the claims and their equivalents.

What is claimed is:

1. An integrated-type suction pipe module for refrigerators, comprising:

a suction pipe to define a refrigerant path between an evaporator in a cooling compartment of the refrigerator and a compressor in a machine room of the refrigerator, wherein said suction pipe includes a middle portion and two end portions;

a foam body;

wherein said middle portion is a part embedded in the foam body to be isolated from atmosphere; and a cover to cover the foam body and the embedded part, wherein each end portion is an exposed part extending outside of the foam body and the cover, wherein the embedded part, foam body and cover are removably mounted only in the machine room of the refrigerator, one of the exposed parts extends to the cooling compartment of the refrigerator and the evaporator, and the other of the exposed parts extends to the compressor.

2. The integrated-type suction pipe module for refrigerators according to claim 1, further comprising a locking part provided at a predetermined portion of the cover to removably mount the cover.

3. The integrated-type suction pipe module for refrigerators according to claim 1, further comprising a tube to cover the exposed part of the suction pipe, which is connected to the evaporator.

4. The integrated-type suction pipe module for refrigerators according to claim 3, wherein the tube is disposed, at an end thereof, in the foam body.

5. The integrated-type suction pipe module for refrigerators according to claim 1, further comprising a capillary tube arranged in parallel and continuously abutting an exterior of the embedded part of the suction pipe.

6. A refrigerator, comprising:

a cooling compartment;

a machine room thermally insulated from the cooling compartment, and opened to an atmosphere;

an evaporator installed at a predetermined position in the cooling compartment;

a compressor installed at a predetermined position in the machine room; and an integrated-type suction pipe module mounted to a predetermined portion of the machine room, and comprising:

a suction pipe, comprising;

first and second exposed parts placed in the machine room; and an embedded part which is placed to be isolated from the atmosphere; and a foam body located only in the machine room and in which the embedded part is disposed.

7. The refrigerator according to claim 6, wherein the integrated-type suction pipe module further comprises a cover to cover the foam body in which the embedded part is disposed.

8. The refrigerator according to claim 7, further comprising a locking part provided at a predetermined portion of the cover to mount the cover to a predetermined portion of the machine room.

9. The refrigerator according to claim 6, wherein the integrated-type suction pipe module further comprises a tube to cover a part of the exposed part of the suction pipe, which is connected to the evaporator.

10. The refrigerator according to claim 9, wherein the tube is disposed, at an end thereof, in the foam body.

11. The refrigerator according to claim 6, wherein the integrated type suction pipe module further comprises a capillary tube arranged in parallel to the suction pipe.

12. An integrated-type suction pipe module for refrigerators, comprising:

a suction pipe to define a refrigerant path between an evaporator in a cooling compartment of the refrigerator and a compressor in a machine room of the refrigerator, wherein said suction pipe includes a middle portion and two end portions;

a foam body;

wherein said middle portion is a winding part embedded in the foam body to be isolated from atmosphere; and a cover to cover the foam body and the embedded part, wherein each end portion is an exposed part extending outside of the foam body and the cover, wherein the embedded part, foam body and cover are removably mounted only in the machine room of the refrigerator, one of the exposed parts extends to the cooling compartment of the refrigerator and the evaporator, and the other of the exposed parts extends to the compressor.

13. The integrated-type suction pipe module for refrigerators according to claim 12, further comprising a locking part provided at a predetermined portion of the cover to removably mount the cover.

14. The integrated-type suction pipe module for refrigerators according to claim 12, further comprising a tube to cover the exposed part of the suction pipe, which is connected to the evaporator.

15. The integrated-type suction pipe module for refrigerators according to claim 14, wherein the tube is disposed, at an end thereof, in the foam body.

16. The integrated-type suction pipe module for refrigerators according to claim 12, further comprising a capillary tube arranged in parallel and continuously abutting an exterior of the embedded part of the suction pipe.

17. A refrigerator, comprising:

a cooling compartment;

a machine room thermally insulated from the cooling compartment, and opened to an atmosphere;

an evaporator installed at a predetermined position in the cooling compartment;

a compressor installed at a predetermined position in the machine room; and an integrated-type suction pipe module mounted to a predetermined portion of the machine room, and comprising:

a suction pipe, comprising;

an exposed part placed in the machine room, and a winding embedded part which is placed to be isolated from the atmosphere; and a foam body in which the embedded part is disposed.

18. The refrigerator according to claim 17, wherein the integrated-type suction pipe module further comprises a cover to cover the foam body in which the embedded part is disposed.

19. The refrigerator according to claim 18, further comprising a locking part provided at a predetermined portion of the cover to mount the cover to a predetermined portion of the machine room.

20. The refrigerator according to claim 17, wherein the integrated-type suction pipe module further comprises a tube to cover a part of the exposed part of the suction pipe, which is connected to the evaporator.

21. The refrigerator according to claim 20, wherein the tube is disposed, at an end thereof, in the foam body.

22. The refrigerator according to claim 17, wherein the integrated-type suction pipe module further comprises a capillary tube arranged in parallel to the suction pipe.

23. A refrigerator, comprising:

a cooling compartment;

a machine room thermally insulated from the cooling compartment, and opened to an atmosphere;

an evaporator installed at a predetermined position in the cooling compartment;

a compressor installed at a predetermined position in the machine room; and an integrated-type suction pipe module mounted to a predetermined portion of the machine room, and comprising:

a suction pipe, comprising;

exposed part placed in the machine room; and an embedded part which is placed to be isolated from the atmosphere; and a foam body in which the embedded part is disposed, wherein the integrated-type suction pipe module further comprises a cover to cover the foam body in which the embedded part is disposed.

24. The refrigerator according to claim 23, further comprising a locking part provided at a predetermined portion of the cover to mount the cover to a predetermined portion of the machine room.

* * * * *